United States Patent [19]

Knabel et al.

[11] Patent Number: 4,458,157

[45] Date of Patent: Jul. 3, 1984

[54] METHOD AND APPARATUS FOR RELEASING A SKI BOOT FROM A SKI

[75] Inventors: Walter Knabel, Murnau, Fed. Rep. of Germany; Nicholas F. D'Antonio, Liverpool, N.Y.

[73] Assignees: Marker-Patentverwertungsgesellschaft mbH., Baar, Switzerland; Kinetronic Industries, Inc., Media, Pa.

[21] Appl. No.: 331,754

[22] Filed: Dec. 17, 1981

Related U.S. Application Data

[63] Continuation-in-part of Ser. No. 190,862, filed as PCT DE79/00073, Jul. 17, 1979, published as WO80/00219, Feb. 21, 1980, § 102(e) date Mar. 19, 1980, abandoned.

[30] Foreign Application Priority Data

Jul. 19, 1978 [DE] Fed. Rep. of Germany ..... 2831769

[51] Int. Cl.[3] ..... H01H 35/00; A63C 9/08

[52] U.S. Cl. ..... 307/119; 280/612

[58] Field of Search ..... 280/612, 613; 307/119, 307/149

[56] References Cited

U.S. PATENT DOCUMENTS

| | | | |
|---|---|---|---|
| 3,907,316 | 9/1975 | Marker et al. | 280/612 |
| 3,919,563 | 11/1975 | Lautier et al. | 307/119 |
| 4,160,555 | 7/1979 | Salomon | 280/612 |

*Primary Examiner*—Donald A. Griffin
*Attorney, Agent, or Firm*—D. Peter Hochberg

[57] ABSTRACT

A method and apparatus for actuating a safety ski binding, for the purpose, in hazardous situations, of automatically releasing a ski boot from a ski on which it is held. The forces exerted by the ski on the leg of the skier are continuously integrated with respect to time. The thus formed time integral of the force releases the connection between the ski and boot on reaching a threshold value representing a product of force×time which is higher than the integration threshold value corresponding to the holding force of the ski binding. To avoid a summation of pulses, a pulse that has not resulted in actuation is cleared through downward integration.

8 Claims, 4 Drawing Figures

METHOD AND APPARATUS FOR RELEASING A SKI BOOT FROM A SKI

This application is a continuation in part of U.S. DE79/00073, on Jul. 17, 1979, published as WO 80/00219, on Feb. 21, 1980, § 102(e) date, Mar. 19, 1980, now abandoned.

FIELD OF THE INVENTION

The invention relates to a method and apparatus of automatically releasing a ski boot from a ski in the event of danger.

BACKGROUND OF THE INVENTION

During the act of skiing, the leg is subject to numerous forces as a controlled descent of the slope is attempted. In the event of a fall, an uncontrolled situation may occur where the forces generated by skier momentum and other forms of stored energy are applied to the leg in an undesirable way. The most dangerous of these forces comes in the form of twisting and bending moments, which produce the highest probability of injury to the bone and tissue. The application of these moments, generally speaking, cause the bone to "wind-up" or "bend", wherein the amount of twist and/or bend depends on the magnitude and duration of the applied forces and is representative of the amount of energy absorbed by the leg. As in any mechanical system, time is needed for the leg to absorb the energy and to then cause an injury, and, likewise, in the event a release is not realized, time is needed to remove the energy once the applied force is eliminated.

U.S. Pat. No. 3,907,316 relates to a method and device for automatically releasing a ski boot from a ski. Use is made of safety ski bindings in which, when a pressure exceeding a given, possibly adjustable, resistance comes into play, a ski boot holder moves from its locking position to its releasing position, thus releasing the ski boot.

The disclosure of U.S. Pat. No. 3,907,316 proposes a method and device for automatically releasing a ski boot from a ski, in the event of danger. Under the method, force pulses acting on the skier's leg are continuously picked up and compared with a predetermined pulse quantity forming a threshold value. When the threshold value is reached, the connection between the ski and ski boot is released.

If the threshold is not exceeded long enough for the force pulses to apply a dangerous energy level to the leg, the ski binding will not release. Moreover, the bone does not absorb this energy in zero time, and neither does it release the energy in zero time. Thus, there is a need for a method of taking into account the release of energy by the bone to produce a proper release of the ski binding. The present invention fills that need.

SUMMARY OF THE INVENTION

The present invention relates to a method and apparatus for actuating a safety ski binding so that, in hazardous situations, a ski boot is automatically released from a ski on which the boot is held by the binding. The method includes the steps of continuously detecting over a time integral the forces exerted by the ski on the leg of the skier and, on reaching a threshold value (actuating characteristic line or static release force) representing a product of force x time which lies above the integration threshold value corresponding to the holding force of the ski binding, releasing the connection between the ski and boot.

The method and apparatus according to the present invention take into account a situation where a measured force pulse does not result in actuation of the ski binding. The method and apparatus contemplate a force-controlled reduction of the measured pulse. According to the method, the negative integral (under the threshold value) is detected and then subtracted from the also detected positive integral (above the threshold value). For the prupose of simplification, when employing the aforementioned actuating characteristic line, the static actuating force can be given as the threshold value for the negative integral.

DETAILED DESCRIPTION OF THE DRAWINGS

Figure 1:
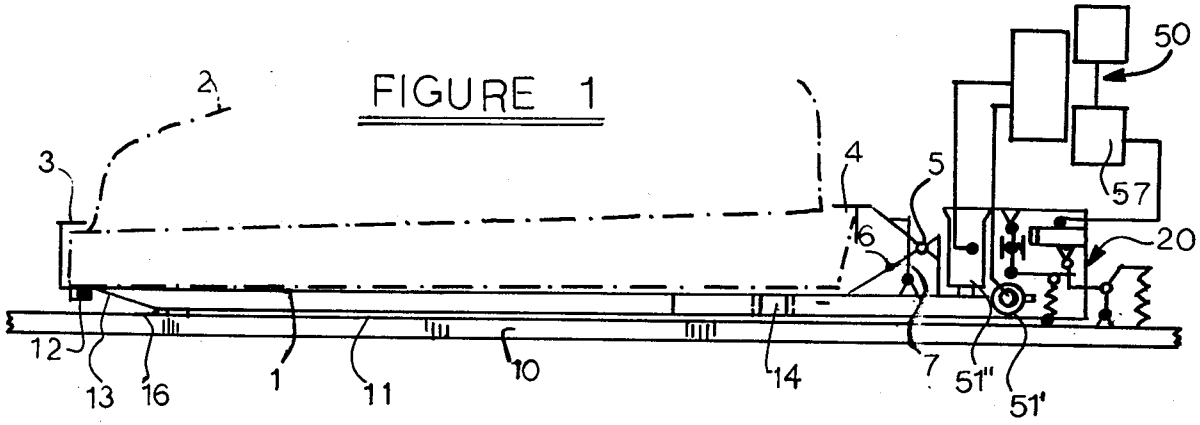
FIG. 1 shows a diagrammatic side view of a safety ski binding device embodying the subject invention and capable of practising the inventive method.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

A safety ski binding embodying the present invention is diagrammatically illustrated in FIG. 1. The ski binding has a sole plate 1 on which a ski boot 2 is held in any given suitable manner, being only arbitrarily detachable. A front sole holder 3 which is not shown in further detail is held on the sole plate for adaptation to various boot sole lengths and thicknesses, both the height and length being adjustable. A rear sole holder 4 can pivot around a horizontal transverse axis 5 and is connected firmly to an entering pedal 6. A swivel bolt 7 is spring-loaded and can be swivelled to the right relative to FIG. 1, for example, by menas of a ski pole tip against spring force, so that the sole holder 4 is released and ski boot 2 can be lifted off sole plate 1. When the ski boot is inserted into the binding, the rear sole end encounters entering pedal 6 and swivels the rear sole holder 4 to its locking position. Swivel bolt 7 then catches automatically. Ski boot 2 is then held quasirigidly on sole plate 1 and, as already mentioned, can be detached only arbitrarily from the sole plate.

The rear sole holder 4 is followed by the electronic pressure recording system which is designated by numeral 50 as a whole and described in detail with reference to FIG. 3.

Figure 2:
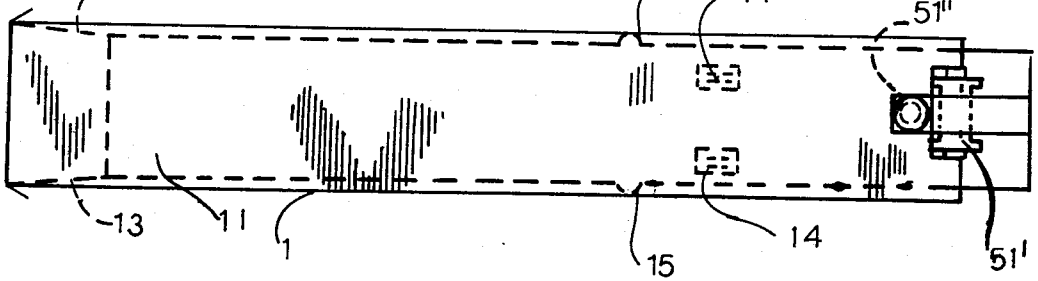
FIG. 2 is a diagrammatic top view of the sole plate and base plate of the device of FIG. 1.

Sole plate 1 is held on the ski via a base plate 11 that can be detached together with it from ski 10. The front end of the sole plate is equipped with a pocket 12 into which two swing arms 13 of the base plate 11 engage. The swing arms are so designed that they take up tensile and compressive forces perpendicular to the ski plane with slight deformations whereas the deformations are relatively great for forces horizontal to the ski plane. Roughly in the range of the rear ski boot, there is a connection between sole plate 1 and base plate 11 via two buffers 14. These buffers are so dimensioned in keeping with the swing arms that they too take up tensile and compressive forces perpendicular to the ski plane with slight deformations and forces horizontal to the ski plane with relatively large deformations. Sole plate 1 overlaps base plate 11 at least along the two long sides. Roughly in the range of the extension of the leg axis, the turning center between the two plates is formed in that base plate 11 has two lateral cams 15 (see FIG. 2) that are in spot-like contact with the longitudinal side walls of sole plate 1 which are drawn downwards. The transverse forces occurring during the travelling motion do not cause the leg to twist and can thus be picked up.

At its rear end, the base plate 11 bears a pressure recorder 51' of the electronic pressure recording system. In a preferred embodiment, the pressure recorder is made up of four strain gauges arranged to form a balance bridge acting as a force pick-up. The pick-up is in active contact with the rear end of sole plate 1, the contact being such that the twisting or torsion forces acting on the sole plate are recorded and measured by the pick-up as twisting or torque moments. Interference quantities are practically eliminated in the torsion measurement by the swing arms 13 and buffers 14. The forces which act on sole holder 4 in a roughly vertical upward direction and occur on frontal loading are transmitted by sole plate 1 to a further pressure recorder 51'' which is likewise four strain gauges arranged to form a balance bridge. This pick-up, which measures force or bending moments, is also connected firmly to base plate 11. The front end of the base plate 11 is held detachably on the ski surface by a ski fitting 16. The base plate is held with its rear end on the ski surface by a locking feature which is designated by numeral 20 as a whole and can be unlocked automatically in the event of danger. The details of the structure and operation of the locking feature are presented in U.S. Pat. No. 3,907,316, issued Sept. 23, 1975 and incorporated by reference herein.

Figure 3:
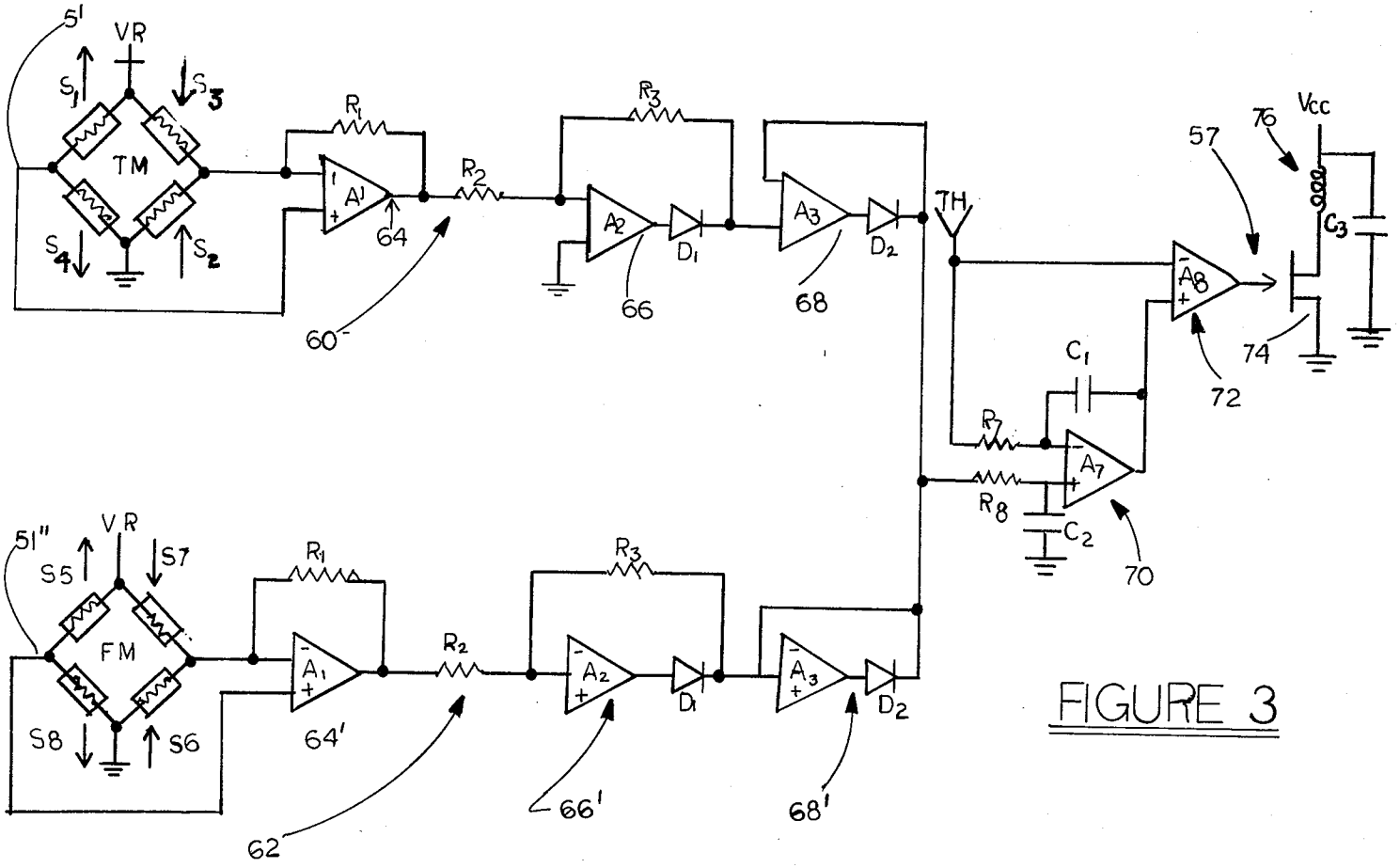
FIG. 3 is a schematic representation of a circuit forming part of the pressure recording system of the device of FIG. 1.

With reference to FIG. 3 a schematic diagram of a preferred embodiment of an electronic circuit forming the electronic pressure recording system is shown. The electronic pressure recording system generally designated as 50 includes a pair of signal detection and processing channels 60 and 62. Considering first channel 60, a first pressure recorder 51', which is used to detect twisting or torque moments, consists of four strain gauges $S_1$ through $S_4$ arranged in a balance bridge. One end of strain gauge $S_1$ and one end of strain guage $S_3$ are connected to a voltage source VR. One end of strain gauge $S_2$ and one end of strain gauge $S_4$ are connected to ground. The remaining ends of strain gauges $S_1$ and $S_4$ form one output of the pressure recorder 51'. The other ends of strain gauges $S_2$ and $S_3$ from the second output of the pressure recorder 51'. The sensing elements $S_1$ through $S_4$ are arranged so that elements $S_1$ and $S_2$ will increase in value and elements $S_3$ and $S_4$ will decrease in value when a clockwise (or counterclockwise) moment is applied and vice versa for a moment in the opposite direction.

The two outputs are then fed to an amplifier made up of an operational amplifier $A_1$ with a feedback resistor $R_1$ across the negative input and the output of the amplifier $A_1$. Resistor $R_1$ determines the amplification of the bridge signal. Typically the amplification value is determined by the maximum range of forces to be detected and the corresponding range of available voltage.

The output of amplifier $A_1$ passes through a resistor $R_2$ and into the negative input of an operational amplifier $A_2$. The positive input of the amplifier $A_2$ is connected to ground. Connected to the output of amplifier $A_2$ is the anode of a diode $D_2$. A resistor $R_3$ is connected across the negative input of amplifier $A_2$ and across the output of the amplifier $A_2$ ahead of diode $D_1$. The configuration of amplifier $A_2$, diode $D_1$ and resistor $R_3$ defines a rectifier 66.

The rectified signal from the output of rectifier 66 then passes into the positive input of an operational amplifier $A_3$. Connected to the output of amplifier $A_3$ is the anode of a diode $D_1$. A feedback path is provided between the cathode of diode $D_2$ and the negative input of amplifier $A_3$. Diode $D_2$, amplifier $A_3$ and the feedback path define a high input impedance voltage follower 68. The minimum input impedance for voltage follower 68 is on the order of $10^{12}$ Ohms.

If the output of amplifier $A_1$ is a positive signal, amplifier $A_2$ will invert it and the negative output of amplifier $A_2$ will back bias diode $D_1$ and make it look as though amplifier $A_2$ is not in the circuit. The positive voltage signal of amplifier $A_1$ will then appear at the input of amplifier $A_3$, which is configured as a high input impedance voltage follower.

If the output of amplifier $A_1$ is negative, again amplifier $A_2$ will invert the signal and this time a positive signal will pass through diode $D_1$ because amplifier $A_2$ behaves like a simple inverting amplifier. There is no voltage loss in diode $D_1$ in this configuration since it is positioned in the feedback loop of amplifier $A_2$ which will provide the additional voltage needed to make up for any loss in diode $D_1$. Again a positive signal appears at the input of amplifier $A_3$ and is passed on to the input of diode $D_2$. In a preferred embodiment resistors $R_2$ and $R_3$ are equal in value to give amplifier $A_2$ a gain of 1 to assure equal treatment of both the positive and negative outputs from amplifier $A_1$.

The second channel 62 contains the same elements as the first channel 60. Thus, channel 62 contains the pressure recorder 51'' having a similar configuration to that of the pressure recorder 51'. Channel 62 also contains an amplifier 64', a rectifier 66' and a voltage follower 68' arranged in a similar manner to amplifier 64, rectifier 66 and voltage follower 68 of channel 60.

The outputs of voltage follower 68 and 68' meet at node $N_1$.

The resultant signal at $N_1$ then passes through resistor $R_8$ into the positive input of operational amplifier $A_7$. The positive input is also connected to ground through capacitor $C_2$. The negative input of operational amplifier $A_7$ receives a threshold signal (TH) after the signal passes through resistor $R_7$. A capacitor $C_1$ is positioned across the negative input and the output of amplifier $A_7$. The output of amplifier $A_7$ in turn is connected to the positive input of operational amplifier $A_8$. The negative input of amplifier $A_8$ receives the threshold signal TH. The output of amplifier $A_8$ produces the signal which is used to activate the locking feature 20 to release the ski boot from the ski on which it is held.

During skiing, the forces of torsion (torque moments) and of a frontal fall (bending moments) acting on the skier's leg are measured continuously. The pulses acting of the skier's leg are thus picked up constantly by the pressure recorders 51'and 51''.

Each of the signals is amplified, rectified and passed through a voltage follower. Because of the employment of the voltage followers 68 and 68', the signal representing the greater of the two moments sensed by recorders 51' and 51'' passes through resistor $R_8$ into the positive input of amplifier $A_7$.

Amplifier $A_7$ with capacitors $C_1$ and $C_2$ and resistors $R_7$ and $R_8$ is configured as a differential integrator. In this way, as long as a signal on $R_8$ is greater than the threshold signal TH, the output of $A_7$ will increase in value. Eventually, the signal at the output of amplifier $A_7$ will reach a value so that it is greater than the threshold value TH. In this case, amplifier $A_8$ will issue an appropriate signal to release the locking feature 20.

If the signal through resistor $R_8$ is below the threshold value, then the differential integrator will integrate in a downward direction. The rate of downward integration is dependant on the magnitude of the force below the point where upward integration began, which corresponds with the philosophy that the bone of the skier does not recover instantaneously, and therefore, neither should the integral. The level where reverse integration begins can, of course, be anywhere from some negative value, if upward integration begins from zero, or some predetermined positive value, if small force signals are to be ignored in that they pose no danger. This latter case is illustrated in the circuit of FIG. 3.

Voltage followers 68 and 68' will provide the larger of their two signals to the input of resistor $R_8$. This is done, because it has been found that the bone responds almost independently to the two moments. If the output of voltage follower 68' is larger than the output of voltage follower 68, diode $D_2$ of follower 68 is cut off and it will appear as though the output of follower 68 is not even there.

Figure 4:
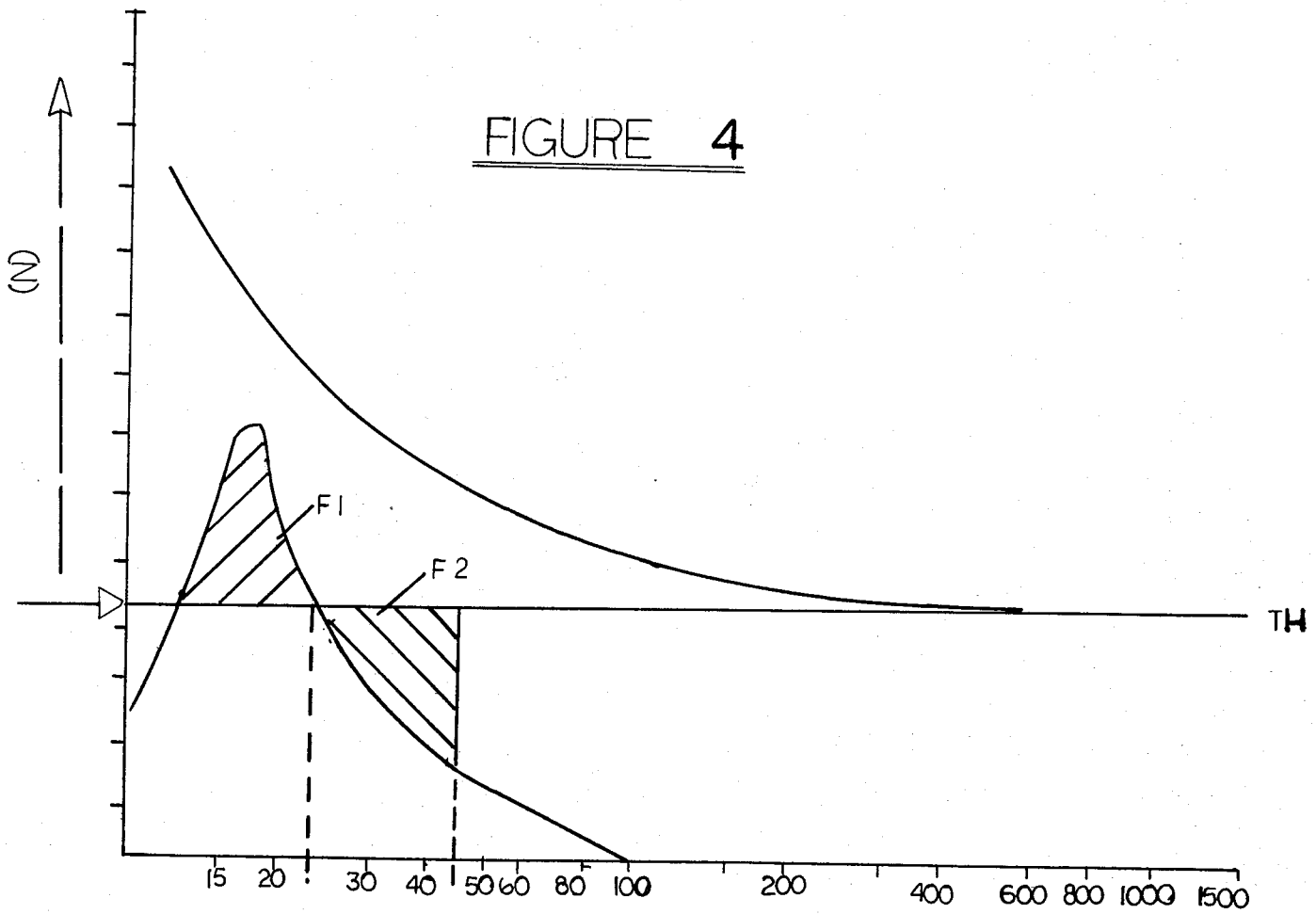
FIG. 4 is a graph showing force v. time characteristics for explaining the operation of the circuit of FIG. 3.

Amplifier $A_7$ is configured as a differential integrator 70. The threshold of integration THD (static release force in the diagram of FIG. 4), in a positive signal. Therefore, if the signal at the input of $R_8$ is smaller than TH, integrator 70 will try to integrate downward or in a negative direction, with its output reaching zero (amplifier $A_7$ is designed for positive output signals only). In this way, a signal not resulting in actuation of the ski binding is cleared. If the input through resistor $R_8$ is larger than TH, a dangerous moment is present, and should it persist for too long, an injury will occur. Thus, the output of amplifier $A_7$ will begin increasing. Should it continue until the output of amplifier $A_7$ exceeds TH, the bone has twisted, wound-up, or absorbed more than a safe amount of energy and amplifier $A_8$, configured as a comparator 72, will change state by going positive, turning on a field effect transistor 74 which will allow capacitor $C_3$ to discharge through a solenoid or plunger coil 76 of the locking feature 20. At this time, a mechanical amplification stage will cause the binding to open.

If no release occurs before the moment is reduced to a value below the threshold signal TH, the integration of amplifier $A_7$ will reverse directions and a controlled decrease of its output signal will occur until it again reaches zero, thus clearing the output signal. At this point, the cycle is completed. The time constant of $R_7C_1$ is set equal to that of $R_8C_2$ in order to realize an accurate integral of the input signals.

Although the present invention has been shown and described in terms of a specific preferred embodiment, it will be appreciated by those skilled in the art that changes or modifications are possible which do not depart from the inventive concepts described and taught herein. Such changes and modifications are deemed to fall within the purview of these inventive concepts.

What is claimed:

1. A method of releasing a ski binding from a latched condition to a released condition, said method comprising the steps of:

continuously detecting forces applied to the binding and generating electrical signals reflective of the value of the detected forces;

integrating the electrical signals in one direction if the electrical signals exceed a first value and integrating the electrical signals in the opposite direction if the electrical signals are less than a second value to yield an integrated output signal; and continuously comparing the integrated output signal with a threshold of release, and generating a release signal to place the bidning in the released condition when the integrated output signal exceeds the threshold of release.

2. The method of claim 1 wherein the first value equals the second value.

3. The method of claim 1 wherein the first value equals the threshold of release.

4. The method of claim 1 wherein the second value equals the threshold of release.

5. An electronic ski binding having a latched condition for retaining a ski boot in the binding and a released condition for enabling removal of the ski boot from the binding, said binding comprising sensing means for continuously detecting forces applied to the binding and for generating electrical signals reflective of the value of the detected forces;

integrating means for integrating said electrical signals in one direction if the electrical signals exceed a first value to produce an integrated signal of increasing value and for integrating said electrical signals in the opposite direction if the electrical signals are less than a second value to produce an integrated signal of decreasing value, to yield an integrated output signal; and comparator means for continuously comparing the value of said integrated output signal with a threshold of release; and for generating a release signal to place the binding in the released condition when the value of the integrated output signal exceeds the threshold of release.

6. The invention according to claim 5 wherein said first value is equal to said second valve.

7. The invention according to claim 5 wherein said first value is equal to the threshold of release.

8. The invention according to claim 5 wherein said second valve is equal to the threshold of release.

* * * * *